United States Patent [19]

Grosshauser

[11] Patent Number: 4,790,243

[45] Date of Patent: Dec. 13, 1988

[54] OFFSET SHORT INKING UNIT WITH DAMPENING FLUID SEPARATION

[75] Inventor: Heinrich K. Grosshauser, Wurzburg, Fed. Rep. of Germany

[73] Assignee: Koenig & Bauer Aktiengesellschaft, Würzburg, Fed. Rep. of Germany

[21] Appl. No.: 67,978

[22] Filed: Jun. 30, 1987

[30] Foreign Application Priority Data

Jul. 4, 1986 [DE] Fed. Rep. of Germany ..... 3622550

[51] Int. Cl.[4] ..... B41C 25/00

[52] U.S. Cl. ..... 101/147; 101/350

[58] Field of Search ..... 101/147, 350

[56] References Cited

U.S. PATENT DOCUMENTS

| | | | |
|---|---|---|---|
| 2,798,426 | 7/1957 | Janke et al. | 101/147 |
| 4,211,167 | 7/1980 | Corse | 101/148 |
| 4,461,211 | 7/1984 | Wesselmann et al. | 101/366 |
| 4,527,471 | 7/1985 | Dahlgren et al. | 101/350 |

FOREIGN PATENT DOCUMENTS

| | | | |
|---|---|---|---|
| 3237868A | of 0000 | Fed. Rep. of Germany . | |
| 3117341C | of 0000 | Fed. Rep. of Germany . | |
| 175635 | 11/1985 | Japan | 101/148 |
| 025137 | 2/1986 | Japan | 101/148 |
| 025139 | 2/1986 | Japan | 101/148 |

*Primary Examiner*—Edgar S. Burr
*Assistant Examiner*—James Lisehora
*Attorney, Agent, or Firm*—Jones, Tullar & Cooper

[57] ABSTRACT

An offset short inking unit includes a screen surface ink fountain roller that is supplied with ink and that transfers the ink to one or more printing plates. Dampening fluid is also supplied to the printing plates from a dampening unit. One or more dampening fluid separation units are placed in contact with the surface of the screened ink fountain roller and operate to remove any residual dampening fluid from the screen roller before this residual dampening fluid can find its way into the fresh ink supply in the ink fountain.

5 Claims, 1 Drawing Sheet

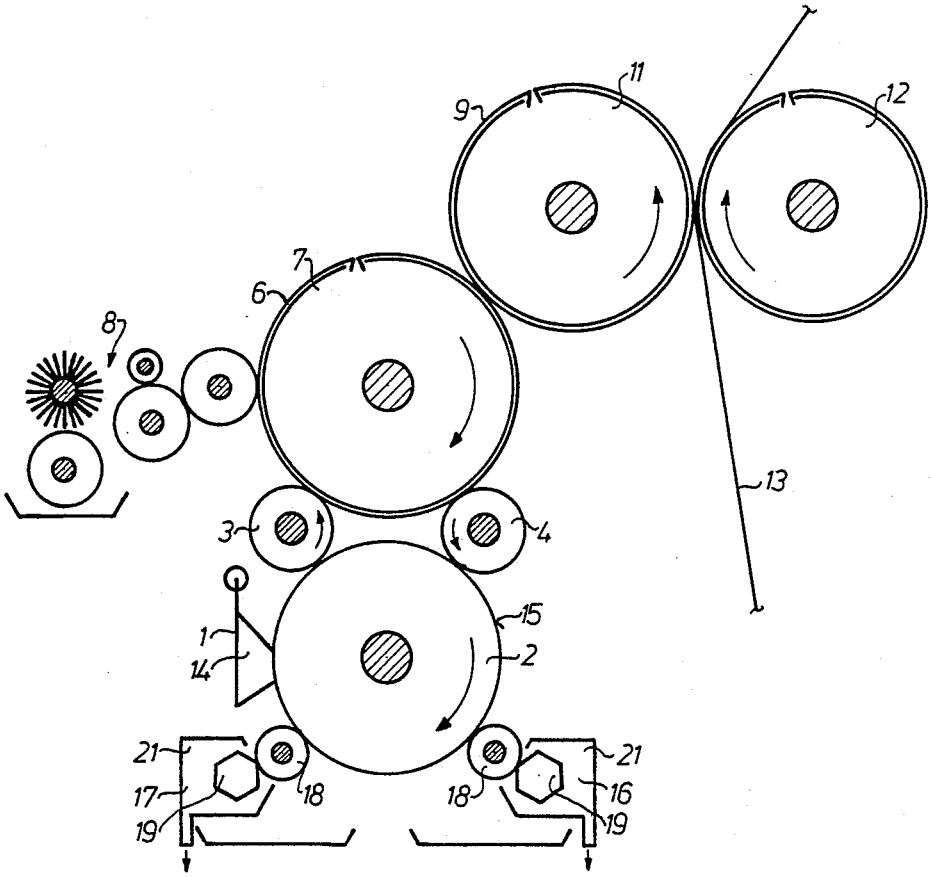
9
11
12
7
6
8
13
3
4
15
1
14
2
21
17
19
18
18
16
19
21

OFFSET SHORT INKING UNIT WITH DAMPENING FLUID SEPARATION

FIELD OF THE INVENTION

The present invention is directed generally to an offset short inking unit. More particularly, the present invention is directed to an offset short inking unit having a screen ink fountain roller. Most specifically, the present invention is directed to an offset short inking unit having a screen ink fountain roller and including at least one damping fluid separation assembly. Each such dampening fluid separation assembly is in contact with the surface of the screen roller seen, in the direction of rotation of the screen surface ink fountain roller, between one or more ink form rollers and a flush inking unit. Each dampening fluid separation unit functions to separate dampening fluid from any ink remaining on the surface of the screen ink fountain roller before that dampening fluid can be carried back into the flush inking unit which supplies ink to the screen roller. This maintains the purity of the fresh ink supply in the inking unit.

DESCRIPTION OF THE PRIOR ART

Various inking fountain assemblies and ink transfer rollers are generally well known in the art. One type of inking fountain is known as a flush inking fountain and such a device is exemplified in U.S. Pat. No. 4,461,211. In such an ink fountain, the reservoir for the ink is formed by spaced upper and lower doctor blades which extend generally parallel to the axis of rotation of a cooperating ink roller, often of the screen type; by spaced end plates; and by the screen ink fountain roller itself.

In German published unexamined patent application No. 3,237,868, there is shown an inking unit that requires no inking keys and which utilizes a screened ink fountain roller and a pair of spaced inking rollers to transfer ink from an ink fountain to a plate on a plate cylinder or the like.

The German patent No. 3,117,341 shows an offset short inking unit in which a screened surface ink fountain roller is again utilized to transfer printing ink from an ink reservoir to a plate cylinder. This patent also illustrates the inclusion of a generally well known dampening unit which is used to supply a dampening fluid, such as water, to the surface of the printing plate or plates carried on the plate cylinder.

In any type of printing, the printing ink must be kept as consistent, particularly with regard to viscosity and purity as possible. The contamination of the fresh ink in the ink reservoir with various impurities, such as dampening fluid is accordingly not desirable when dampening fluid mixes with the printing ink in the ink reservoir, it reduces both the viscosity and purity of the ink and thus reduces the quality of the printed work produced by the printing press.

Dampening fluid, such as water, is apt to find its way into the ink fountain reservoir by moving back from the dampening unit through the printing plate or plates to the ink fountain roller and then into the main ink supply in the ink fountain. If this occurs to a substantial degree, the purity of the printing ink may be adversely affected to the point that the ink may have to be drained and discarded.

As may be appreciated from the above discussion, the problem of printing ink contamination by the unwanted addition of dampening fluid is a substantial one. There is therefore a need for an offset short inking unit having a dampening fluid separation capability. The offset short inking unit of the present invention provides such a device.

SUMMARY OF THE INVENTION

It is an object of the present invention to provide an offset short inking unit.

Another object of the present invention is to provide an offset short inking unit having a screen ink fountain roller.

A further object of the present invention is to provide an offset short inking unit having a flush inking unit.

Yet another object of the present invention is to provide an offset short inking unit having at least one dampening fluid separation unit.

Still a further object of the present invention is to provide an offset short inking unit having a plurality of dampening fluid separation units.

Even yet another object of the present invention is to provide an offset short inking unit having one or more dampening fluid separation units spaced about the periphery of the screened ink fountain roller.

As will be discussed in greater detail in the description of the preferred embodiment which is set forth hereinafter, the offset short inking unit of the present invention includes a screened ink fountain roller that receives printing ink from a flush inking unit. One or more ink form rollers transfer the ink from the surface of the screen roller to one or more printing plates carried on a printing plate cylinder. A dampening unit supplies dampening fluid, such as water, to the printing plates. A portion of this dampening fluid tends to stay on the printing plates and eventually works back onto the screen ink fountain roller One or more dampening fluid separation units are positioned about the screen roller and these units separate dampening fluid from the ink and dampening fluid carried by the screen roller before this dampening fluid can get into the printing ink in the flush ink unit. Each dampening fluid separation unit utilizes at least a pair of rollers whose rotational speeds are selected to separate dampening fluid from ink by centrifugal force.

The primary advantage of the offset short inking unit of the present invention is that it effectively separates dampening fluid from the ink carried back to the ink fountain by the screen roller. Thus the ink in the flush inking unit, or other similar inking unit, is not adulterated by dampening fluid. This ensures that the quality and viscosity of the ink will not be adversely affected and thus the quality of the printing done by the press will also not deteriorate.

The offset short inking unit of the present invention provides a simple, effective solution to the problem of ink supply contamination by preventing dampening fluid from getting into the printing ink. The unit accomplishes this result in a manner that is superior to prior art devices and which utilizes one or more spaced dampening fluid separation units which are efficient yet uncomplicated.

BRIEF DESCRIPTION OF THE DRAWING

While the novel features of the offset short inking unit of the present invention are set forth with particularity in the appended claims, a full and complete understanding of the invention may be had by referring to the detailed description of the preferred embodiment, as is set forth subsequently, and as is illustrated in the accompanying sole drawing figure which shows a diagrammatic side view of an offset short inking unit in accordance with the present invention.

DESCRIPTION OF THE PREFERRED EMBODIMENT

Referring now to the sole drawing figure, a flush inking unit 1 fills the indentations in a screened surface ink fountain roller 2 with printing ink in a generally conventional manner. A pair of spaced ink forme rollers 3 and 4 are placed adjacent screen roller 2 and contact the surface of the screen roller 2. These ink form rollers, 3 and 4, are located downstream, in the direction of rotation of screen roller 2, from flush inking unit 1.

Ink supplied by flush inking unit 1 to screen ink fountain roller 2 is transferred by ink form rollers 3 and 4 to one or more printing plates 6 which are carried on the periphery of a rotatable formed cylinder 7. Dampening fluid is also supplied to each printing plate 6 by a generally well known dampening unit 8 that is illustrated as a brush type unit, but which could be any generally known dampening unit. Once printing plate 6 has been inked and dampened, it transfers its image to a blanket 9 carried on a first blanket cylinder 11. This image is then printed onto a paper web 13 that is fed between first blanket cylinder 11 and a second blanket cylinder 12 which also may be some other type of counterpressure cylinder.

During the above described, generally well known printing process, it is possible for dampening fluid to fill in the partially drained recessed in the screened ink fountain roller 2. For example, dampening fluid may pass from the printing plates 6, around the periphery of the ink form rollers 3 and 4, and into the surface recesses on screened ink fountain roller 2. This dampening fluid, in the absence of any countermeasures, will be carried along with the mainstream of ink on the screen roller 2 and will find its way into the supply of fresh printing ink in the ink chamber 14 of the flush inking unit 1.

As may be seen in the drawing, first and second dampening fluid separation units 16 and 17, in accordance with the present invention, are provided as part of the offset short inking unit. Each of these dampening fluid separating units 16 and 17 operates to separate dampening fluid from the printing ink carried in the recesses on the surface of the screen ink fountain roller 2. Each of these dampening fluid separation units is positioned, in the direction of rotation of screen ink fountain roller 2, between the last or downstream ink form roller 4 and the flush inking unit 1. Thus each dampening fluid separation unit 16 and 17 contacts the screened peripheral surface 15 of screen ink fountain roller 2 to remove any dampening fluid transferred by printing plates 6 to ink form rollers 3 and 4 and thence to screen ink fountain roller 2. Such separation is accomplished before the dampening fluid contaminated ink returns to the flush inking unit 1 so that the ink in ink chamber 14 remains essentially free of dampening fluid.

Each dampening fluid separation unit 16 and 17, for use in separating the dampening fluid from the printing ink, may include a rubber or similarly resilient surface roller 18 and a separating roller 19 that is made having a hydrophilic surface. Rubber roller 18 is positioned to securely engage the surface 15 of screen roller 2 and may be in squeeze contact therewith. In a similar manner, the periphery of separating roller 19 is in squeeze surface contact with rubber roller 18. Screened roller 2, rubber roller 18, and separating roller 19 all, in the preferred embodiment, rotate with the same circumferential speed. This may be accomplished by attaching driving toothed wheels (not shown) to the ends of all three rollers 2, 18, and 19. Alternatively, if desired, the rubber roller 18 and separating roller 19 may be driven by frictional contact with each other and with screen ink fountain roller 2.

As may be seen in the drawing, the diameters of each rubber roller 18 and each cooperating separating roller 19 are only a fraction of the size of the diameter of screen ink fountain roller 2. For example, the diameters of rollers 18 and 19 may be about one-tenth the diameter of the screen ink fountain roller 2. However, if desired, the diameter of rubber roller 18 may be larger than the diameter of separating roller 19. The diameter of rubber roller 18 is selected so that neither particles of ink or water will be able to be detached from the surface of the rubber roller 18 by centrifugal force, even at the highest operating speeds of the equipment. The diameter of the separating roller 19 is however selected, in combination with the material used to form its surface, so that even at the slowest possible printing speeds, a substantially large enough centrifugal force will be developed so that the droplets of dampening fluid, but not the droplets of printing ink, will be detached from the surface of the separating roller 19. These droplets of dampening fluid, which are centrifuged off the surface of the separating roller 19 of each dampening fluid separation unit, are caught in one of the chambers 21 which surround rollers 18 and 19 of each of the dampening fluid separating units 16 and 17. This collected dampening fluid may then drain off through suitable drain means located in each separating unit. If desired, the separating rollers 19 may have a polygonal cross-sectional shape, as seen in the drawing. This shape creates a plurality of edges which increase the detaching effect of the droplets of dampening fluid so that more complete dampening fluid separation from the surface of separating rollers 19 may be attained.

In operation, ink is supplied to the surface 15 of screen roller 2 by flush inking unit 1. This ink is carried by screen roller 2 to ink form rollers 3 and 4 where it is at least partially transferred to printing plates 6 on formed cylinder 7. Dampening fluid is also applied to printing plates 6 from dampening unit 8. Any residual printing ink and dampening fluid remaining on printing plate 6, after plate 6 has contacted blanket 9 on first blanket cylinder 11, will be transferred back onto the surface 15 of screen roller 2 through ink form rollers 3 and 4. Before this ink and dampening fluid mixture can be brought around to flush inking unit 1, it must pass the spaced dampening fluid separating units 16 and 17 positioned intermediate last ink form roller 4 and inking unit 1. As described above, these separating units are effective in removing the dampening fluid from the ink so that essentially no dampening fluid can find its way into the fresh ink supply in ink chamber 14 of flush inking unit 1.

While a preferred embodiment of an offset short inking unit in accordance with the present invention has been fully and completely set forth hereinabove, it will be apparent to one of skill in the art that a number of changes in for example the type of ink fountain, the type of dampening unit, the number of printing plates, the number of dampening fluid separation units and the like may be made without departing from the true spirit and scope of the present invention which is accordingly to be limited only by the following claims.

What is claimed is:

1. An offset short inking unit for supplying ink to at least one printing plate that also receives dampening fluid from a dampening fluid supply unit, said offset short inking unit comprising:

a screen surface ink fountain roller;

means to supply printing ink to a surface portion of said screen surface ink fountain roller;

at least a first ink form roller contacting said screen surface ink fountain roller and the at least one printing plate to transfer said printing ink to the at least one printing plate; and at least a first dampening fluid separation unit having a rubber roller contacting said surface portion of said screen surface ink fountain roller and a separating roller having a polygonal cross-sectional shape contacting said rubber roller, said at least first dampening fluid separation unit being positioned in the direction of rotation of said ink fountain roller intermediate said at least first ink form roller and said ink supply means.

2. The offset short inking unit of claim 1 wherein said ink supply means is a flush inking unit.

3. The offset short inking unit of claim 1 further including a second ink form roller contacting said screen surface ink fountain roller.

4. The offset short inking unit of claim 1 further including a second dampening fluid separation unit.

5. The offset short inking unit of claim 1 wherein said rubber roller and said separating roller have diameters substantially less than a diameter of said screen roller.

* * * * *